11/19/85 XR 4,553,917

United States Patent [19]

Lee

[11] Patent Number: 4,553,917

[45] Date of Patent: Nov. 19, 1985

[54] APPARATUS FOR PRODUCTION OF ULTRAPURE AMORPHOUS METALS UTILIZING ACOUSTIC COOLING

[75] Inventor: Mark C. Lee, La Canada, Calif.

[73] Assignee: The United States of America as represented by the Administrator of the National Aeronautics and Space Administration, Washington, D.C.

[21] Appl. No.: 451,896

[22] Filed: Dec. 21, 1982

[51] Int. Cl.[4] ..... B22F 9/00; F16C 32/00

[52] U.S. Cl. ..... 425/6; 65/21.2; 65/142; 73/505; 219/121 LE; 219/121 LY; 264/5; 264/23; 264/237; 425/174.2

[58] Field of Search ..... 425/6, 10, 7, 174.2; 65/21.1, 21.2, 141, 142; 73/505; 219/121 L, 121 LE, 121 LF, 121 LY, 121 FS; 264/5, 23, 237

[56] References Cited

U.S. PATENT DOCUMENTS

| | | | |
|---|---|---|---|
| Re. 31,473 | 12/1983 | Kilby et al. | 425/6 |
| 2,189,387 | 2/1940 | Wissler | 425/6 |
| 2,510,574 | 6/1950 | Greenhalgh | 425/6 |
| 3,476,170 | 11/1969 | Christian et al. | 219/121 LE |
| 4,122,240 | 10/1978 | Banas et al. | 219/121 LE |
| 4,163,637 | 8/1979 | Hendricks | 425/6 |
| 4,218,921 | 8/1980 | Oran et al. | 73/505 |
| 4,264,641 | 4/1981 | Mahoney et al. | 425/6 |
| 4,279,632 | 7/1981 | Frosch et al. | 65/142 |
| 4,326,842 | 4/1982 | Adachi et al. | 425/10 |
| 4,393,708 | 7/1983 | Barmatz et al. | 73/505 |
| 4,400,191 | 8/1983 | Youngberg et al. | 65/21.4 |
| 4,402,221 | 9/1983 | Lee et al. | 73/505 |
| 4,447,251 | 5/1984 | Dunn et al. | 425/6 |

FOREIGN PATENT DOCUMENTS

| | | | |
|---|---|---|---|
| WO82/00635 | 3/1982 | PCT Int'l Appl. | 219/121 LE |

*Primary Examiner*—Jay H. Woo
*Assistant Examiner*—James C. Housel
*Attorney, Agent, or Firm*—Paul F. McCaul; John R. Manning; Thomas H. Jones

[57] ABSTRACT

Amorphous metals are produced by forming a molten droplet (115) of metal from source (126) and deploying the droplet into a focused acoustical levitating field or by dropping the unit through spheroidizing zone (116) slow quenching zone (118) and fast quenching zone (120) in which the droplet is rapidly cooled by in the standing acoustic wave field produced between half-cylindrical acoustic driver (168) and focal reflector (166) or curved driver (38) and reflector (50). The cooling rate can be further augmented by first cryogenic liquid collar (160) and second cryogenic liquid jacket (170) surrounding the drop tower (112). The sphere (117) is quenched to an amorphous solid which can survive impact in the unit collector (124) or is retrieved by vacuum chuck (20).

6 Claims, 4 Drawing Figures

APPARATUS FOR PRODUCTION OF ULTRAPURE AMORPHOUS METALS UTILIZING ACOUSTIC COOLING

ORIGIN OF INVENTION

The invention described herein was made in the performance of work under a NASA contract and is subject to the provisions of Section 305 of the National Aeronautics and Space Act of 1958, Public Law 83-568 (72 Stat 435; 42 USC 2457).

TECHNICAL FIELD

The present invention relates to apparatus for the production of amorphous metals and, more particularly, to apparatus for producing amorphous metals, alloys or compounds in containerless environments employing acoustic cooling.

BACKGROUND ART

Recent industrial tests of amorphous alloys under realistic working environments have indicated that the wear and corrosive resistances of this new category of alloys are at least one order of magnitude higher than that of conventional alloys currently in use. Other amorphous metal compounds are of interest as superconductors and magnetically soft alloys, etc.

The formation of amorphous metals requires varying degrees of rapid cooling. Three techniques currently in use have been most successful in fabricating metallic glasses of various geometries and sizes: 1. Liquid quenching (LQ), 2. Sputtering, and 3. Electrodeposition (ED). The first preparation of an amorphous metal from the corresponding liquid was done by a gun technique. In this process, a diaphragm is ruptured by high pressure gases, the ensuing shock waves travel down the tube to a crucible with a small hole in the bottom. The molten sample is held in the crucible by its surface tension before being driven out of the hole in the form of small droplets by the shock waves. The droplets then impinge on a metal substrate, spreading out and overlapping to form an irregular foil. Other variations of this fundamental technique include twin roll technique, melt spinning, melt extraction, pendent drop process, laser glazing, chill block casting, etc. A variety of atomic deposition techniques have also been utilized to form amorphous metals. The latter techniques have higher effective cooling rates than liquid quench processes and thus present the potential for retention of phases with considerably higher free energy excess than the equilibrium phases.

In all the above-mentioned techniques, a crucible and/or substrate must be used at one point in the process. The intimate contact of the melt with a foreign surface inevitably introduces impurities into the molten metal, which become heterogeneous nucleation sites and detrimentally increase the rate of crystalline growth within the melt during its cooling process. In fact, recent experiments on PdSi have produced conclusive evidence that the extremely high rate of cooling required in the metallic glass formation is primarily due to the necessity to suppress this type of nucleation process.

Important progress in the theoretical and experimental areas has been made in recent years to provide conclusive evidences that:

1. Surface heterogeneous nucleations were responsible for activating global nucleation process;

2. Heterogeneous and homogeneous bulk nucleations played insignificant roles in an overall crystallization process; and 3. For the same cooling rate condition, by decreasing the number of surface heterogeneous nucleation sites, the size of the amorphous samples was increased.

Logically, if the surface heterogeneous nucleation sites could be reduced in number or eliminated altogether, the only crystallization process left is that due to the bulk, which could be suppressed with a very modest cooling rate. Depending on the size of the sample, the rate could be as low as 1° K./sec. With a low cooling rate, the homogeneous nucleation rate may be small enough to permit bulk formation of amorphous alloys.

Some earlier attempts to form bulk amorphous alloys have employed containerless processing. In this earlier work melts were injected into a drop tube. The gaseous atmosphere was selected to minimize surface heterogeneous nucleation sites.

Theoretically, the containerless processing of molten alloys under high vacuum will certainly eliminate environmental impurities from making contact with the melt during the solidification period, thereby enhancing the conditions favorable for bulk homogeneous nucleations. In this case, the quench is due to radiative cooling. If the starting alloy is idealistically pure, this cooling rate may probably be sufficient for the formation of bulk metallic glasses. Realistically, however, this kind of condition may never be achievable in laboratory. Or it may not be economically feasible.

In addition, realistic processing time in a drop tube may never exceed several seconds. During this time period, the sample must be cooled down enough to stand the impact of landing. This may call for a cooling rate more rapid than that due to radiation alone. Consequently, some exchange gas must be used. This may expose the melt to external impurities such as $O_2$ and $H_2O$.

Preliminary experiments on a PdCuSi system using a drop tube facility to produce amorphous solid spheres of several millimeters in diameter have been successful. Rapid cooling is provided by a 200 mm Hg helium exchange gas in the free-falling path of the droplet. Practical difficulties have limited the processing time of this technique to only several seconds. Space, on the other hand, provides an ideal containerless and zero-gravity environment. Many experiments along this line have been considered and proposed. A terrestrial levitation apparatus which is electrostatic, electromagnetic or acoustic in nature has also been considered and a development of such apparatus is in progress.

The electrostatic levitation apparatus has been limited to manipulate materials of low specific gravity. The electromagnetic system can levitate and heat samples of high gravities. However, the rapid quenching of the samples is not readily available. Acoustic levitation systems currently in use for terrestrial applications in the past could not handle heavy materials with acceptable lateral positional stability. In addition, depending on the thermal properties of the material, the acoustic integrity of the apparatus deteriorates rapidly as the sample is being heated to its melting temperature.

STATEMENT OF THE INVENTION

An apparatus for contactless cooling of molten metal samples permitting extremely high quenching rates has been developed in accordance with this invention. A novel acoustical focusing radiator is utilized to increase jet streaming. Cooling rates from $10^{4°}$ K./sec and higher are achieved by use of acoustic jet streaming. Molten metal samples have been cooled without contamination from contact with solid surfaces or exchange gases. The cooling rate exceeds the critical quenching rate and converts the molten droplet to a viscous amorphous state capable of surviving impact in the collection zone.

Larger spheres can be produced as compared to prior processes. The spheres exhibit an ultrasmooth surface characteristic of amorphous glass phases.

The acoustic levitation eliminates most heterogeneous nucleations at the surface and homogeneous nucleations can be suppressed with the cooling rates provided by acoustic jet streaming. In the absence of heterogeneous nucleation, the quenching rate required for glass formation is much lower enabling production of larger amorphous samples, novel amorphous alloys and higher volume production. In the focusing radiator approach of the invention the molten sample is levitated in a bidirectional acoustic standing wave field. In this configuration the rate of cooling is approximately 20 times higher than in absence of the bidirectional field and a clear pumping activity is observed. Depending on the sound pressure level applied, two types of streaming originating from the two pressure-antinode surfaces and the solid sample can coexist with different relative strength. Their existence is a simple consequence of Newton's third law of motion. Their relative strength depends on the sound pressure levels and geometries of the resonant cavity and sample. At very high sound pressure level, the jet streaming originating from the solid sample surface could be dominant, resulting in a vortex pattern. This high velocity acoustic jet streaming is regarded as responsible for the high cooling rate experimentally observed.

These and many other features and attendant advantages of the present invention will become apparent as the invention becomes better understood by reference to the following detailed description when considered in conjunction with the accompanying drawings.

DETAILED DESCRIPTION OF THE INVENTION

Figure 1:
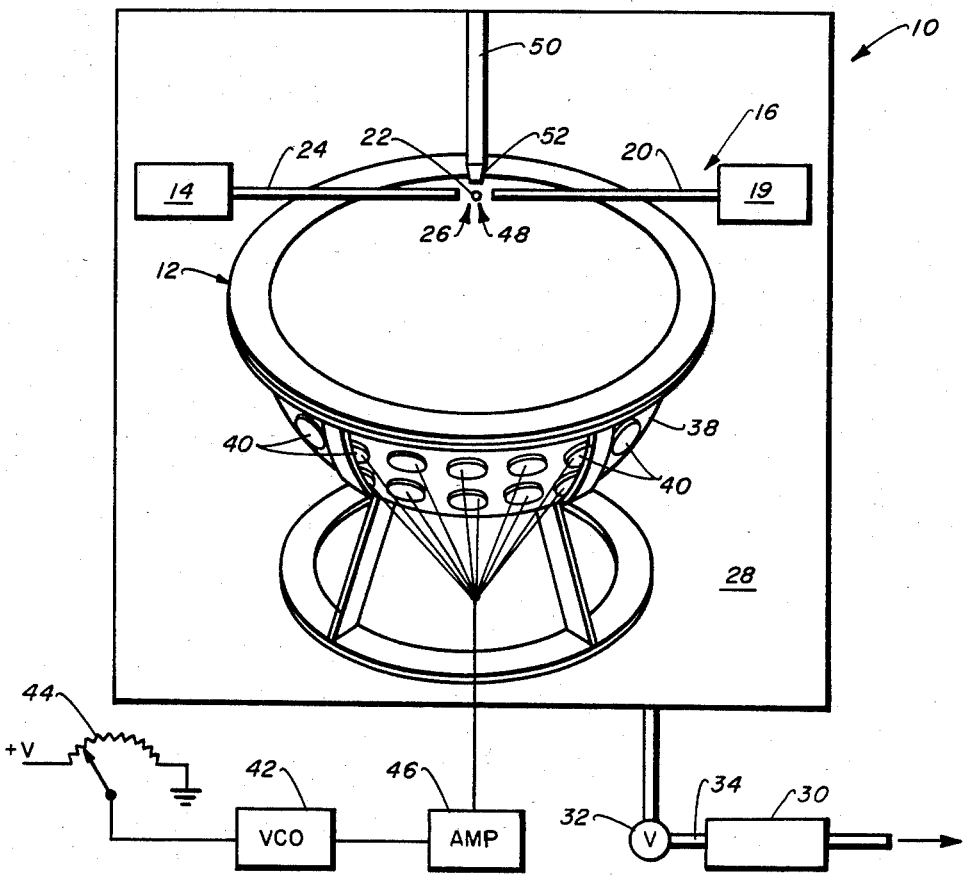
FIG. 1 is a view of a first apparatus for forming amorphous metals with acoustic levitation and jet stream cooling according to this invention.

The apparatus of the invention can be utilized to cool and solidify any ultrapure molten material while avoiding contaminating from feeding mechanisms, cooling gases or the cooling apparatus itself. The molten material may be a pure metal, an alloy, a refractory, ceramic or glass compound. The system of the invention is partially useful in the preparation of amorphous or glassy metal or metallic compounds resulting from fast quenching from the molten state to freeze the randomness of the atomic distribution resulting in a structureless solid state.

The apparatus of the invention increases the cooling rate by 20 to 100 times as compared to radiation and convection cooling experienced by a falling body. The melt can contain a pure metal such as nickel or gold which requires quench rates of about $10^{12°}$ K./sec and $10^{9°}$ K./sec, respectively, for metallic glass formation. Most alloys require a quench rate in the range of $10^{6°}$ K./sec for glass formation while special alloys such as NiNb need a quench rate from $10^3$ to $10^{5°}$ K./sec. Examples of alloys that can be processed into metallic glasses in accordance with the invention are PdCuSi, AuPbSb, CuZr, etc., which require a quench rate not to exceed $10^{6°}$ K./sec.

The invention proceeds by contactless formation of a molten droplet of metal glass precursor, deploying the droplet into an acoustic jet stream near the focus of a focusing radiator, cooling the droplet to a viscous, metal-glass, near-solid state and collecting a solid sphere. The focusing radiator can be disposed at an upwardly directed focus capable of levitating the molten object or the radiator can be disposed vertically with a sideward elongated focus for cooling a molten droplet by jet streaming as it falls adjacent the line of focus.

The molten droplet experiences the following temperature history where Tm is the melting temperature of the molten material to be process into an amorphous metal glass:

TABLE 1

| Location of Droplet | Temperature of Ambient | Temperature of Droplet |
|---|---|---|
| Melting Zone | T > Tm | T > Tm |
| Spheroidization Zone | T = T ambient | T > Tm |
| First (optional) Cooling Zone | T = T Cryogenic Liquid I | T < Tm |
| Focus of Radiator | T = Cryogenic II Liquid II | |
| Entrance | | T = 0.6 to 0.9 Tm |
| Exit | | T = 0.1 to 0.3 Tm |
| Collection Zone | T = T ambient | T = T ambient |

The acoustic source directs acoustic energy generally toward a focus, with the source having portions on either side of its axis which vibrate along local axes which are not parallel to each other, but which are instead directed substantially at the focus. An acoustic reflector positioned near the focus, reflects sound to create an intense local field near the reflector which stably supports a small object such as a molten droplet.

The acoustic source can include a curved plate and a plurality of transducers in intimate facewise contact with a surface of the plate and located on opposite sides of the axis of the curved plate. Each transducer vibrates the plate in a direction toward and away from the focus to assure the generation of a converging acoustic wave pattern. The reflector is positioned much closer to the focus than the acoustic source, and can be concavely curved to a much smaller radius of curvature than the source to produce an intense localized acoustic field. With the reflector located about one-half wavelength beyond the focus, a small object is stably supported one-quarter wavelength from the reflector. Suitable acoustic sources for practice of the present invention are disclosed in Copending Application Ser. No. 272,837, filed June 12, 1981 for ACOUSTIC SUSPENSION SYSTEM, the disclosure of which is expressly incorporated herein by reference.

Referring now to FIG. 1 the levitation and jet stream cooling apparatus 10 includes a droplet deploying means 16, heating means 14, acoustic levitation and cooling means 12 and collection means.

The metal material is not as sensitive to contact when in the solid state. Therefore, the metal material and the final glassy material can be handled without substantially affecting the required quenching rate for glass formation or amorphous characteristics of the final product. The handling means can be mechanical fingers, a circular or flat chuck or a vacuum chuck 20, as shown. The vacuum chuck 20 is connected to a source of vacuum 18. The heating means can be resistance or high energy frequency heating or a laser 24 having its output optical axis directed at the point of levitation 26 occupied by the droplet of metal material 22.

The apparatus 10 may be contained within a chamber 28 maintained at desired pressure by means of a pressure controller 30 connected to the chamber by means of a line 34 containing a valve 32.

The levitation and cooling source is in the form of a hemispherical, focusing-radiator acoustical driver 38 having a plurality of transducers 40 attached to the back-surface of the driver. The transducers are driven in synchronism by an oscillator 42, the frequency of which is controlled by the output of a voltage source 44. The output of the oscillator is amplified in amplifier 46 before delivery to the transducers. The axes of vibration of the various transducers 40 converge on a focal point 48. A reflector 50 having a concave surface 52 is positioned just outside the focal point 48.

Figure 4:
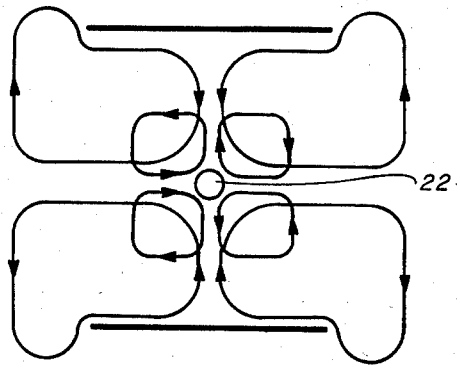
FIG. 4 is a schematic view of the acoustic jet streaming surrounding a solid sample in the bidirectional acoustic standing wave field.

When the transducers 40 are driven by oscillator 42 and amplifier 46, the focusing-radiator driver 38 oscillates and generates sound waves converging on the focal point 48 adjacent the reflector 50 to form an acoustic standing wave field. As an object such as the droplet 22 is placed in the standing wave field, a bidirectional acoustic pumping action results. The pattern of the acoustic jet stream surrounding the molten droplet 22 in a bidirectional acoustic standing wave field is schematically shown in FIG. 4. Depending on the sound pressure level applied, two types of jet streaming originating from the two pressure-antinode surfaces and the solid sample can coexist with different relative strengths. Their existence is a simple consequence of Newton's third law of motion. Their relative strength depends on sound pressure levels and the geometries of the resonant cavity and sample. At a very high sound pressure level exceeding about 172 db (reference pressure is $2\times10^{-4}$ dyne/cm$^2$), the jet stream originating from the object predominates resulting in the high velocity swirling jet streams.

The liquid droplet sphere modifies the flow forming new acoustic boundaries. Net flow forces create the bidirectional jet streaming which provides acoustic levitation, increases the volumetric levitational force and stabilizes lateral positioning of the object. The fast rate of flow of the acoustic jet stream provides an increase in the rate of cooling from 20 to 100 times over free fall cooling through a drop tower.

The system 10 is operated by opening valve 32 and operating pressure controller 30 until the pressure in the chamber 28 is adjusted to the desired level. The driver 38 is then driven by oscillator 42, voltage source 44 and amplifier 46 to create a bidirectional standing wave converging on the focal point 48. The metal material is engaged at the end of the vacuum chuck 20 and is deployed from the vacuum chuck 20 into the point of levitation 26 adjacent the focus 48 by terminating vacuum from the vacuum source 18 to the vacuum chuck 20. The laser 24 is actuated to melt the metal material to form a droplet 22. The jet stream cools the droplet to form a metal glass solid which can be retrieved by terminating the acoustic field and dropping the solid into the driver 38 or by actuating vacuum pump 18 and applying vacuum to the end of the vacuum chuck 20 to collect the metal glass solid.

Figure 2:
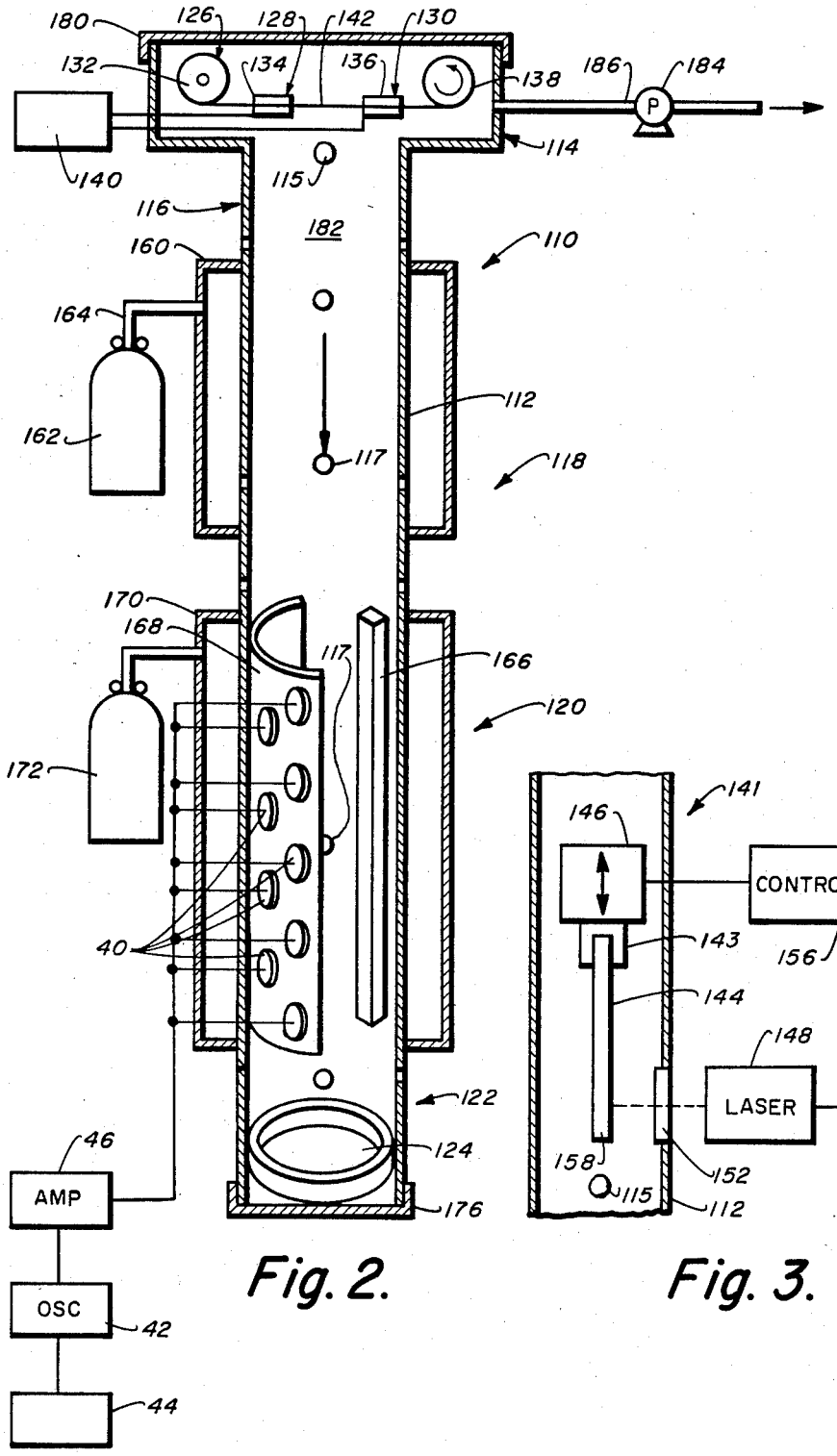
FIG. 2 is a perspective view of a further embodiment of a system in accordance with this invention.

Referring now to FIG. 2 the apparatus 110 can be contained within an elongated tube or tower 112 having an upper zone 114 for containerless production of a droplet 115 of molten material, a spheroidizing zone 116, a first slow quenching zone 118, a rapid quenching zone 120 and a collection chamber 122 housing a removable collector 124.

The zone 114 includes a source 126 of pure solid metal or metal compound and a means 128 of heating the source to produce a molten unit 115 of material positioned to fall into the vertical tube under the force of gravity. As shown in FIG. 2 a low rate unit feeder 130 comprises a spool 132 of foil threaded between clamp electrodes 134, 136 and pulled by driven take up spool 138. On application of current from power source 140 to the electrodes, the foil section 142 between the electrodes 134, 136 will melt and fall to form droplet 115.

Figure 3:
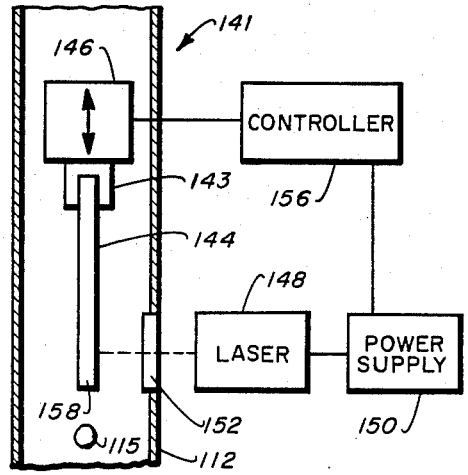
FIG. 3 is a schematic view of a system illustrating an alternate molten feeding mechanism.

A higher rate feed mechanism is illustrated in FIG. 3. A rod feeding device 141 is centrally mounted in the tube 112. The device contains a chuck 143 holding the metal rod 144 connected to a feeding mechanism 146. A laser 148 connected to power supply 150 is mounted outside the tube 112 in optical alignment with the rod 144 through a window 152. The power supply 150 and the feeding mechanism 146 are connected to controller 156. When a signal is generated by the controller 156 the feeding mechanism advances the rod 144 downwardly and synchronously pulses the laser 148 to generate a laser beam which melts the rod section 158 to produce a molten falling droplet 115. This feeding mechanism can be operated at a very high rate.

As shown in Table 1 the temperature of droplet is greater than Tm (melting temperature of feed material) as the droplet leaves the upper feeding zone. Fluid dynamics cause spheroidization of the falling molten droplet 115 to form a sphere 117 as the droplet 115 falls through a long ambient temperature zone 116. In the first quenching zone 118, the sphere 117 is subjected to radiative cooling by means of a heat exchange collar 160 receiving a flow of cryogenic liquid such as liquid nitrogen (77.3° K.) from tank 162 through line 164. The sphere 117 exits the zone 118 at a temperature of from 0.90 to 0.60 Tm, usually 0.75 Tm.

The sphere 117 then enters the fast quenching zone 120. In this zone the sphere falls down a line just inside a reflector 166 placed adjacent the focal point of the half-cylindrical acoustic exiter 168. The transducers 40 are driven in synchronism by an oscillator 42 controlled by voltage source 44 and amplified by amplifier 46. The cooling rate can be further augmented by disposing a second cryogenic cooling jacket 170 around the zone 120 and feeding a lower temperature cryogenic liquid such as liquid Helium (4.2° K.) or liquid hydrogen (20° K.) to the jacket 170 from the second cryogenic liquid source 172. The sphere is quenched to an amorphous solid which falls through the collection chamber 122 into the collector 124 and can be recovered by removing end plate 176.

A chamber 182 is formed by enclosing the tower 112 by a top member 180 and an end plate 176. The chamber 182 is maintained under reduced pressure by means of vacuum pump 184 connected to the chamber 182 by conduit 186. Generally, the chamber is maintained at pressure below half atmosphere, usually from 100 to 300 mm Hg.

It has been reported that preliminary experiments have resulted in amorphous bulk spheres about 1.5 mm in diameter for a PdCuSi alloy processed containerlessly in a drop tube. Recent experiments in a 45 foot stainless steel drop tube have produced amorphous spheres of AuPBSb alloy 2 mm and larger. The process of the invention utilizing acoustic levitation and cooling can produce much larger amorphous bulk spheres of the order of 5 mm or larger.

It is to be realized that only preferred embodiments of the invention have been described and that numerous substitutions, modifications and alterations are permissible without departing from the spirit and scope of the invention as defined in the following claims.

I claim:

1. An apparatus for forming amorphous containing spheres comprising in combination:

an elongated tower enclosure defining an elongated, vertical closed chamber, having an upper droplet deployment zone followed by a free-fall zone, a first heat exchange zone and a collection zone;

droplet forming means within the upper zone for heating material to above the melting temperature of the material to form a droplet;

deployment means within the upper zone for deploying the molten droplet into the chamber along a line into the free fall zone for spheroiding the droplet;

a first heat exchange means surrounding said first zone for receiving a flow of a first cryogenic liquid for cooling the droplet to form said solid sphere, an elongated acoustical source disposed within the first zone for generating a converging acoustical wave pattern along a line of focus adjacent the line of deployment to cool and stabilize position of the solid sphere as it falls along the line;

said source including an elongated, curved, semicylindrical plate having opposed sides including a plurality of opposed sets of transducers, each set directed at a common focal point along said focal line, means for oscillating the transducers, and an elongated reflector having a curved semicylindrical surface with a radius of curvature less than that of the plate mounted adjacent the focal line of the plate for creating an intense local acoustic field for stably supporting the droplet; and recovery means within the collection zone for recovering the solid spheres.

2. An apparatus according to claim 1 further including pressure controller means connected to the enclosure for forming a partial vacuum within the chamber.

3. An apparatus according to claim 1 in which the tower further includes a second heat exchange means surrounding the tower in the vicinity of the free fall zone for receiving a flow of second cryogenic liquid.

4. An apparatus according to claim 1 in which the droplet forming means includes material feeding means.

5. An apparatus according to claim 4 further including controller means connected to said droplet forming means for intermittent and synchronous heating and feeding of said material.

6. An apparatus according to claim 5 in which the droplet forming means further includes a laser having its output beam positioned in line with the output of the feeding means.

* * * * *